US009109588B2

(12) United States Patent
Couto et al.

(10) Patent No.: US 9,109,588 B2
(45) Date of Patent: Aug. 18, 2015

(54) BLOCK FOR A RECIPROCATING REFRIGERATION COMPRESSOR

(75) Inventors: Paulo Rogerio Carrara Couto, Joinville-Sc (BR); Ingwald Vollrath, Joinville-Sc (BR)

(73) Assignee: Whirlpool S.A., São Paulo-Sp (BR)

( * ) Notice: Subject to any disclaimer, the term of this patent is extended or adjusted under 35 U.S.C. 154(b) by 752 days.

(21) Appl. No.: 13/392,344

(22) PCT Filed: Aug. 26, 2010

(86) PCT No.: PCT/BR2010/000281

§ 371 (c)(1), (2), (4) Date: Apr. 4, 2012

(87) PCT Pub. No.: WO2011/022799

PCT Pub. Date: Mar. 3, 2011

(65) Prior Publication Data

US 2012/0183423 A1 Jul. 19, 2012

(30) Foreign Application Priority Data

Aug. 27, 2009 (BR) ..... 0902973

(51) Int. Cl.

| | |
|---|---|
| ***F04B 53/16*** | (2006.01) |
| ***F04B 35/04*** | (2006.01) |
| ***F04B 39/00*** | (2006.01) |
| ***F04B 39/02*** | (2006.01) |
| ***F04B 39/12*** | (2006.01) |

(52) U.S. Cl.

CPC ..... *F04B 35/04* (2013.01); *F04B 39/0022* (2013.01); *F04B 39/023* (2013.01); *F04B 39/12* (2013.01); *F04B 39/121* (2013.01); *F04B 39/122* (2013.01); *F04B 39/128* (2013.01)

(58) Field of Classification Search

CPC .... F04B 35/04; F04B 39/0022; F04B 39/023; F04B 39/12; F04B 39/121; F04B 39/122; F04B 39/128; F04B 39/0094

USPC ..... 92/60, 69 B, 72, 74, 140, 261

See application file for complete search history.

(56) References Cited

U.S. PATENT DOCUMENTS

| | | | | |
|---|---|---|---|---|
| 2,738,122 | A | 3/1956 | Gardiner | |
| 3,491,939 | A * | 1/1970 | Holme et al. | 74/605 |
| 3,563,677 | A * | 2/1971 | Retan | 417/415 |
| 2005/0089416 | A1 | 4/2005 | Lee | |

FOREIGN PATENT DOCUMENTS

| | | |
|---|---|---|
| EP | 0498061 A1 | 8/1992 |

* cited by examiner

*Primary Examiner* — Dwayne J White
*Assistant Examiner* — Logan Kraft
(74) *Attorney, Agent, or Firm* — Gifford, Krass, Sprinkle, Anderson & Citkowski, P.C.

(57) ABSTRACT

The block (B) comprises a piston hub having a horizontal axis (X) and housing a piston and a shaft hub housing a crankshaft and having a vertical axis (Y) intersecting the horizontal axis (X). The block (B) incorporates a connecting portion having a first end attached to a region of the piston hub disposed on a side of the horizontal axis (X) opposite to that turned to the shaft hub, and a second end attached to an adjacent end portion of the shaft hub. The connecting portion is elastically deformable by a resulting bending moment (MF) generated: by a first compression derived force (F1) actuating on the second end of the connecting portion; and by a second compression derived force (F2) applied to a free end portion of the shaft hub and which tends to provoke an angular displacement of the vertical axis (Y) of the shaft hub in the direction of the first compression derived force (F1).

4 Claims, 5 Drawing Sheets

MF = 0

MF ≠ 0

BLOCK FOR A RECIPROCATING REFRIGERATION COMPRESSOR

FIELD OF THE INVENTION

The present invention refers to a constructive arrangement of blocks for reciprocating compression mechanisms employed in refrigeration compressors, either hermetic or not.

PRIOR ART

Refrigeration compressors of the reciprocating type, that is, with a reciprocating piston, usually have a mechanical assembly basically comprised by a block, a crankshaft, one or more connecting rods and one or more pistons, which are particularly arranged to allow the crankshaft rotative movement, which is provided by an electric motor of the compressor, to be converted into a reciprocating linear movement of each piston.

A conventional construction for a reciprocating compressor of the type illustrated in FIGS. 1 and 2 presents, in the interior of a shell (not illustrated), a block B which defines a piston hub (or cylinder) 10 having a horizontal axis X and within which a piston 20 reciprocates.

The block B is also provided with a shaft hub 30 having an adjacent end portion 31, a free end portion 32 and a vertical axis Y which intersects the horizontal axis X of the piston hub 10, said shaft hub 30 housing a crankshaft which incorporates an eccentric end portion 45 projecting outwards from the adjacent end portion 31 of the shaft hub 30 and operatively coupled to the piston 20 by means of a connecting rod 50.

In the present study, the axis of the crankshaft 40 is considered as coincident with the vertical axis Y of the shaft hub 30, independently of the operational condition of the compressor.

Around the eccentric end portion 45 of the crankshaft 40 is mounted a larger eye 51 of the connecting rod 50, whose smaller eye 52 is coupled to the piston 20, by a wrist pin 53. The crankshaft 40 is coupled to an electric motor rotor, not illustrated, which rotates said crankshaft 40 in order to reciprocate the piston 20. Generally, the lower portion of the crankshaft 40 further carries, in this type of compressor, an oil pump (not illustrated) which conveys oil from an oil sump, defined in a lower portion of the shell, to the compressor parts to be lubricated. Said oil pump can also be coupled to the eccentric end portion 45 in compressors in which the mechanical assembly in the shell is invertedly mounted. The block B generally supports, in an end portion 70, a stator (not illustrated) of the electric motor.

In this prior art construction, the piston hub 10 is formed in an upper portion of the block B and the shaft hub 30 is formed in a lower portion of said block B, said upper and lower portions of the block B being joined to each other, in a single-piece, by a connecting portion 60 defined between the horizontal axis X of the piston hub 10 and the adjacent end portion 31 of the shaft hub 30.

In this known construction, during the gas compression in the piston hub 10, the compression reaction force F which actuates against the eccentric end portion 45 of the crankshaft 40 is transmitted to the block B, by the crankshaft 40, in the adjacent end portion 31 and the free end portion 32 of the shaft hub 30, applying to said portions a first and a second compression derived forces F1, F2 which in turn are derived from the compression reaction force F.

Further according to said prior art construction, the connecting portion 60 defines a single and solid structural connection between a respective piston hub 10 and the shaft hub 30.

During compression of the piston, the compression reaction force F is applied to the crankshaft 40, against its eccentric end portion 45, in the direction of the horizontal axis X, forcing the crankshaft 40 away from the piston hub 10. Said reaction force F tends to provoke an elastic angular deformation of the eccentric end portion 45 of the crankshaft 40, inclining its axis Z away from the piston hub 10 by an angle $\alpha$ in relation to the vertical axis Y of the shaft hub 30.

This compression reaction force F applied to the eccentric end portion 45 of the crankshaft 40 is transmitted to the block B in its adjacent end portion 31 and free end portion 32 of the shaft hub 30, by the first and second compression derived forces F1, F2. Both the first and second compression derived forces F1, F2, applied to the shaft hub 30, impart to the latter an angular displacement, in relation to the connecting portion 60, by the first and second bending moments M1, M2, respectively, which combine in a resulting bending moment MF. Said angular displacement of the shaft hub 30 is directed toward the piston hub 10 and occurs, by an angle $\beta$, in relation to the nominal positioning of the piston hub vertical axis Y, elastically deforming the connecting portion 60 and making the vertical axis Y of the shaft hub 30 lose its orthogonality in relation to the horizontal axis X of the piston hub 10, forming with said axis an angle $\omega$ slightly inferior to 90° (see FIGS. 1 and 3).

The resulting bending moment MF assumes the direction indicated in FIG. 3 by being predominantly comprised by the second bending moment M2 applied to the free end portion 32 of the shaft hub 30, since the first compression derived force F1, applied to the adjacent end portion 31 of the shaft hub 30, is projected on the connecting portion 60 and thus has its lever arm reduced. Accordingly, the first bending moment M1, caused by the first compression derived force F1, is also minimized in relation to the connecting portion 60.

The angular deformations, to which the shaft hub 30 and the eccentric end portion 45 of the crankshaft 40 are submitted during the compression cycles, make the axis Z of the eccentric end portion 45 lose its orthogonality in relation to the horizontal axis X of the piston hub 10, forming with said axis an obtuse angle corresponding to the sum of $90°+\alpha+\beta$, causing the misalignment between the eccentric end portion 45 of the crankshaft 40 and the connecting rod 50.

The orthogonality loss between the axis of the eccentric end portion 45 and the horizontal axis X of the piston hub 10 and of reciprocating displacement of the latter, causes the misalignment between the eccentric end portion 45 of the crankshaft 40 and the connecting rod 50, which fact tends to damage the bearing of the larger eye 51 of the latter around said eccentric end portion 45. Besides, this geometric deviation projects radial forces on the piston 20, forcing the latter against the inner wall of the piston hub 10, increasing the energy consumption and the metallic contact between components, with consequent high wear rates which reduce the durability and reliability of the compressor. The geometric deviation cited above is, therefore, highly undesirable.

It should also be noted that, apart from the angular deformations of the eccentric end portion 45 and of the shaft hub 30, there can also occur manufacture geometric deviations which can increase even more the misalignment between the crankshaft 40 and the connecting rod 50, impairing the efficiency and durability of the compressor.

In higher capacity compressors, this problem is even more pronounced due to higher compression loads. In order to reduce the misalignments generated by the deformation of the components, it is used a shaft with the bearings positioned symmetrically to the load line coincident with the axis X. Although this embodiment minimizes the effects of the component deformation on the bearing misalignment, it makes the manufacture and assembly of both the crankshaft 40 and the connecting rod 50 more complex.

SUMMARY OF THE INVENTION

Due to the inconveniences of the known constructive solutions, it is a generic object of the present invention to provide a constructive arrangement for a refrigeration compressor of the type having a reciprocating piston as discussed above, which allows minimizing wear in the bearings of the larger eye of the connecting rod around the eccentric end portion of the crankshaft and of the piston in the interior of the piston hub.

It is a more specific object of the present invention to provide a constructive arrangement of the type mentioned above, which minimizes deformations effects resulting from the compression reaction force on the assembly formed by the crankshaft and the shaft hub.

It is another object of the present invention to provide an arrangement, as cited above and which further allows compensating the existence of the manufacture geometric deviations of the compressor, contributing even more to minimize misalignments between the eccentric end portion of the crankshaft and the larger eye of the connecting rod.

These and other objects are attained through a block for a reciprocating refrigeration compressor, of the type which includes a block comprising at least one piston hub having a horizontal axis and housing a reciprocating piston, and a shaft hub having an adjacent end portion, a free end portion and a vertical axis which intersects the horizontal axis of the piston hub, said shaft hub housing a crankshaft which incorporates an eccentric end portion projecting outwards from the adjacent end portion of the shaft hub and coupled to the piston by a connecting rod.

According to the present invention, the block incorporates a connecting portion having a first end attached to a region of the piston hub disposed on a side of the horizontal axis of the latter which is opposite to that side turned to the shaft hub, and a second end attached in the adjacent end portion of the shaft hub, said connecting portion defining a single structural connection between the piston hub and the shaft hub, and being elastically deformable by a bending moment resulting: from a first compression derived force, actuating on the second end of the connecting portion and imparting to the shaft hub a first moment; and from a second compression derived force applied, by the crankshaft, to the free end of the shaft hub and imparting, to the latter, a second moment opposite to the first one, said bending moment tending to provoke, by elastic deformation of the connecting portion, an angular displacement of the vertical axis of the shaft hub, in the direction of the first compression derived force, said elastic deformation of the connecting portion annulling or limiting, to a predetermined value, the angular displacement of the vertical axis of the shaft hub away from the orthogonality in relation to the horizontal axis of the piston hub.

In a particular aspect of the present invention, the elastic deformation of the connecting portion is determined to limit the angular displacement of the vertical axis of the shaft hub away from the orthogonality in relation to the horizontal axis of the piston hub, to a value corresponding to an angular displacement of the eccentric end portion of the crankshaft in the opposite direction, by a compression reaction force applied to the crankshaft eccentric portion by the connecting rod, during the compression cycles of the piston.

As a function of the structural dimensioning of the connecting portion, the construction presented herein allows that the resulting bending moment, generated by the difference between the intensities of said two opposite first and second bending moments, actuating on the shaft hub in relation to the connecting portion, produces an elastic deformation of the connecting portion. Through the structural dimensioning of the connecting portion, the elastic deformation of the latter is capable of annulling or limiting, to a predetermined value, the angular displacement of the vertical axis of the shaft hub away from the orthogonality in relation to the horizontal axis of the piston hub.

However, when the elastic deformation of the connecting portion is determined only to annul the angular displacement of the vertical axis, one cannot avoid the loss of orthogonality of the axis of the eccentric end portion of the crankshaft, in relation to the horizontal axis of the piston hub, accompanied with the undesirable consequences mentioned above, when said loss of orthogonality cannot be absorbed by the bearing mounting of the connecting rod in the crankshaft and the piston in the piston hub.

In order to maintain the orthogonality of the axis of said eccentric end portion in relation to the horizontal axis of the piston hub, the structural dimensioning of the connecting portion can be made so as to allow the resulting bending moment to provoke an elastic deformation of said connecting portion, said deformation being sufficient only to angularly displace the axis of the shaft hub by an angle which compensates the angular deformation of the eccentric end portion of the crankshaft, maintaining said eccentric end portion with its axis orthogonal to the axis of the piston hub.

BRIEF DESCRIPTION OF THE DRAWINGS

The invention will be described below, with reference to the enclosed drawings, given by way of example and in which.

DETAILED DESCRIPTION OF THE INVENTION

Figure 1:
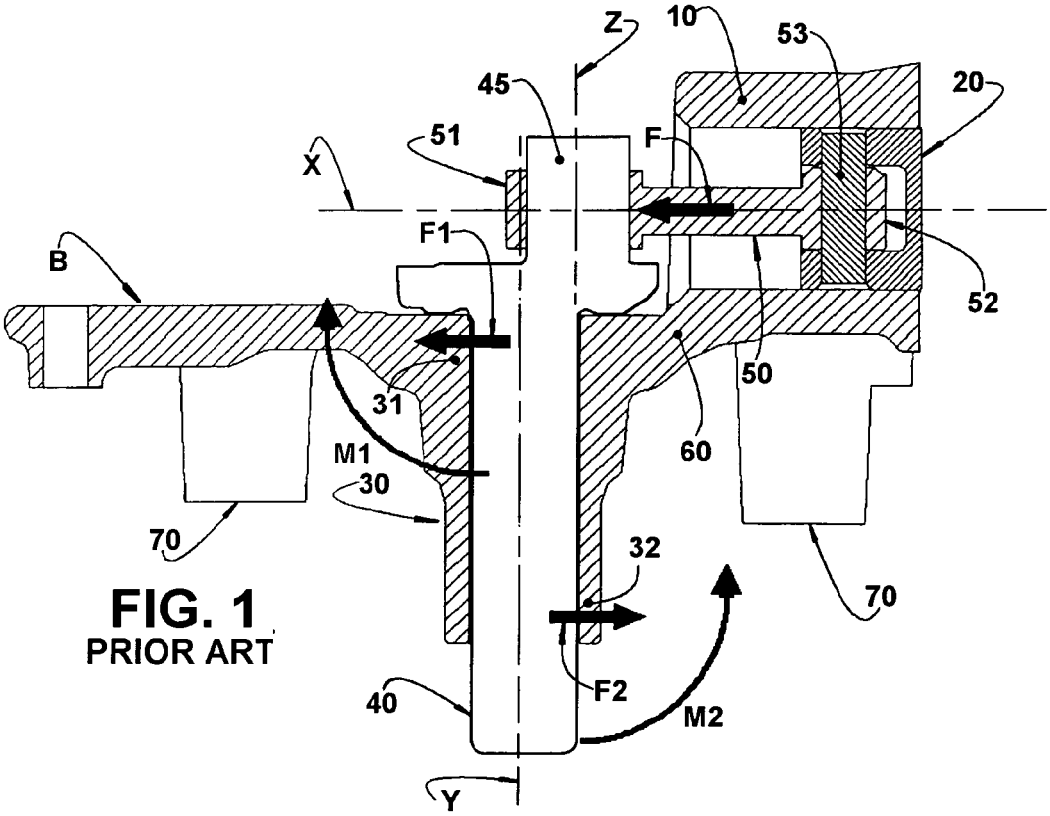
FIG. 1 PRIOR ART
FIG. 1 represents, schematically, a longitudinal sectional view of a block constructed according to the prior art and presenting the axes of the shaft hub, of the piston hub and of the eccentric end portion of the crankshaft not deformed by the compression reaction forces and, therefore, maintaining the nominal orthogonality of the project.
Figure 2:
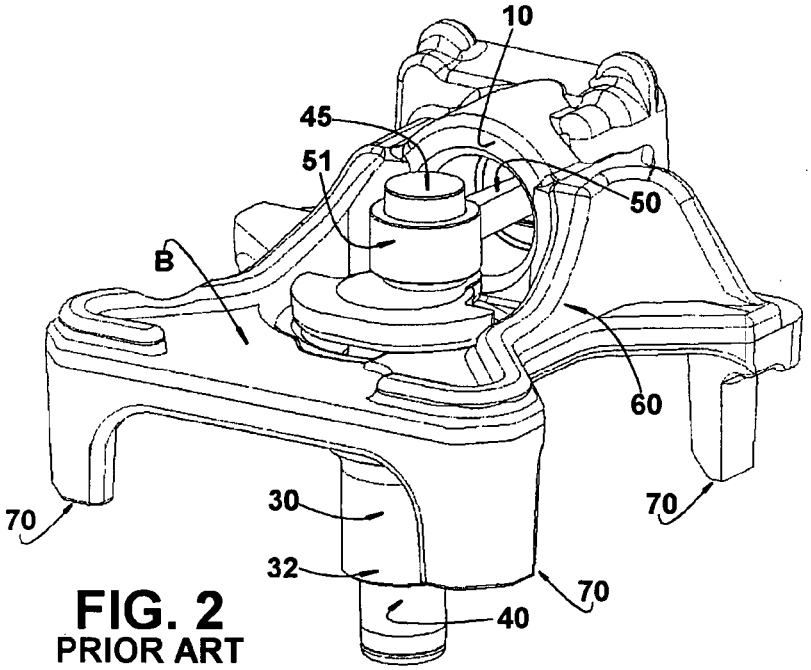
FIG. 2 PRIOR ART
FIG. 2 represents a simplified upper perspective view of the block constructed according to the prior art illustrated in FIG. 1.
Figure 3:
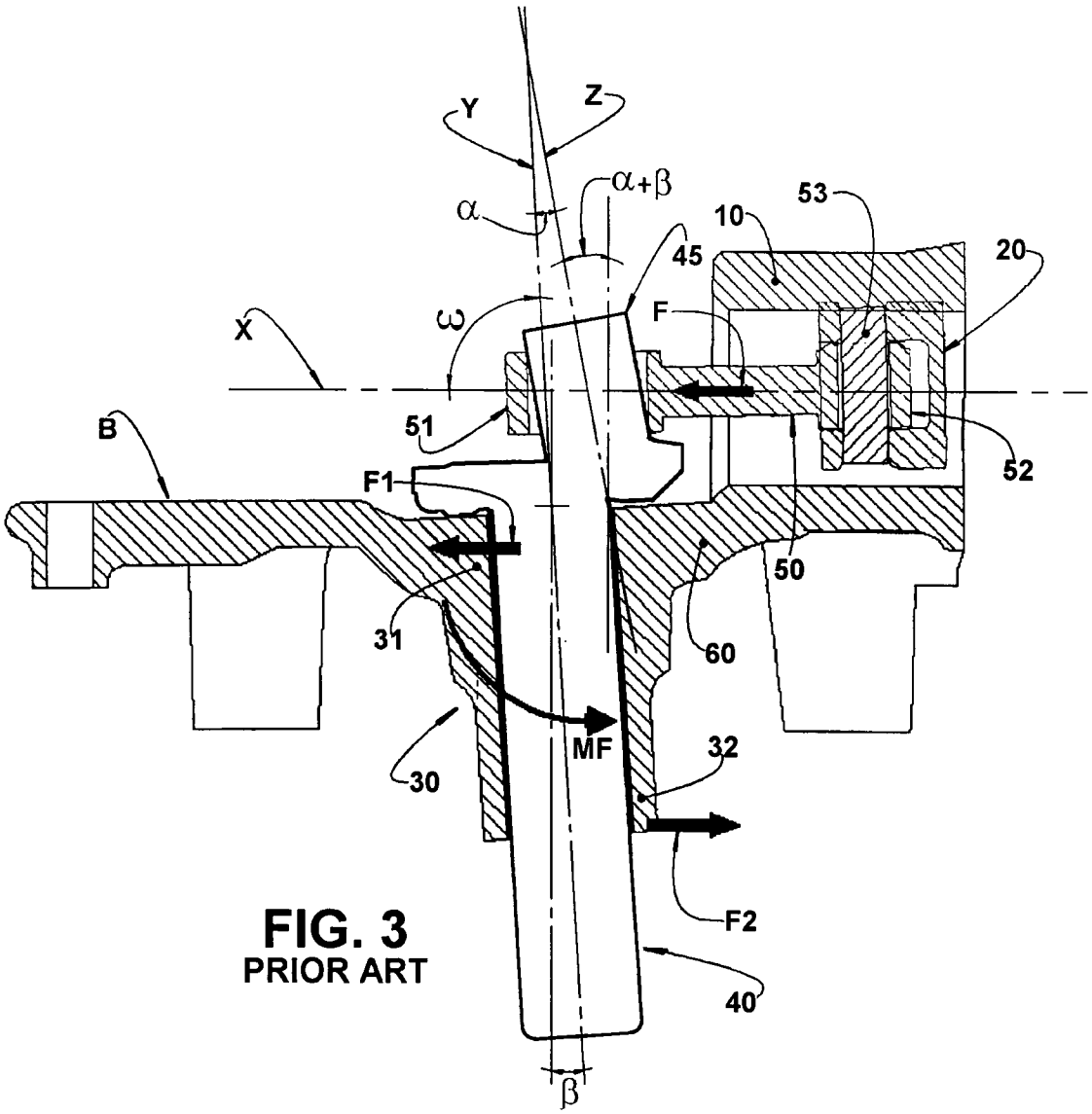
FIG. 3 PRIOR ART
FIG. 3 represents a view similar to that of FIG. 1, but presenting the shaft hub and the eccentric end portion of the crankshaft deformed by the compression reaction forces and presenting their axes angularly displaced away from the orthogonality in relation to the horizontal axis of the piston hub.

As illustrated herein, the present invention is designed to be applied to a refrigeration compressor, more specifically to a reciprocating compressor, either hermetic or not, of the type previously described and which presents, in the interior of a shell (not illustrated), a block B which comprises at least one piston hub 10 having a horizontal axis X and housing a reciprocating piston 20, and a shaft hub 30 having an adjacent end portion 31, a free end portion 32 and a vertical axis Y which intersects the horizontal axis X of the piston hub 10, said shaft hub 30 housing a crankshaft 40 which incorporates an eccentric end portion 45 projecting outwards from the adjacent end portion 31 of the shaft hub 30 and coupled to the piston 20 by a connecting rod 50.

According to the arrangement of the present invention, block B incorporates at least one connecting portion 60, each having a first end 61 attached to a region of a respective piston hub 10 disposed on a side of the horizontal axis X of the latter which is opposite to that side turned to the shaft hub 30, and a second end 62 attached to the adjacent end portion 31 of the shaft hub 30.

Each connecting portion 60 defines a single structural connection between a respective piston hub 10 and the shaft hub 30 and is structurally constructed so as to be elastically deformable, by a resulting bending moment MF generated by: a first compression derived force F1, actuating on the adjacent end portion 31 of the shaft hub 30 and imparting a first bending moment M1 to the connecting portion 60, particularly in the second end 62 of the connecting portion 60; and a second compression derived force F2 applied, by the crankshaft 40, to the free end portion 32 of the shaft hub 30 and imparting, to the latter, a second bending moment M2 opposite to the first bending moment M1.

According to the present invention, the resulting bending moment MF tends to provoke, by the elastic deformation of the connecting portion 60, an angular displacement of the vertical axis Y of the shaft hub 30, in the direction of the first compression derived force F1, of higher magnitude. Said elastic deformation of the connecting portion 60 annuls or limits, to a predetermined value, the angular displacement of the vertical axis Y of the shaft hub 30 away from the orthogonality in relation to the horizontal axis X of the piston hub 10. The resulting bending moment MF, in relation to the connecting portion 60, assumes the direction opposite to that presented in the prior art construction since, in the present invention, the adjacent end portion 31 of the shaft hub 30, on which the first compression derived force F1 is applied, is distant from the joint line of the connecting portion 60 and, thus, the first bending moment M1 predominates over the second bending moment M2, once the first compression derived force F1 is sufficiently higher than the second compression derived force F2. In order that the first compression derived force F1 predominates over the second compression derived force F2, the assembly crankshaft 40-rotor assembly is specially conceived so that the center of gravity of said assembly is approximated to the free end portion 32 of the shaft hub 30.

Figure 4:
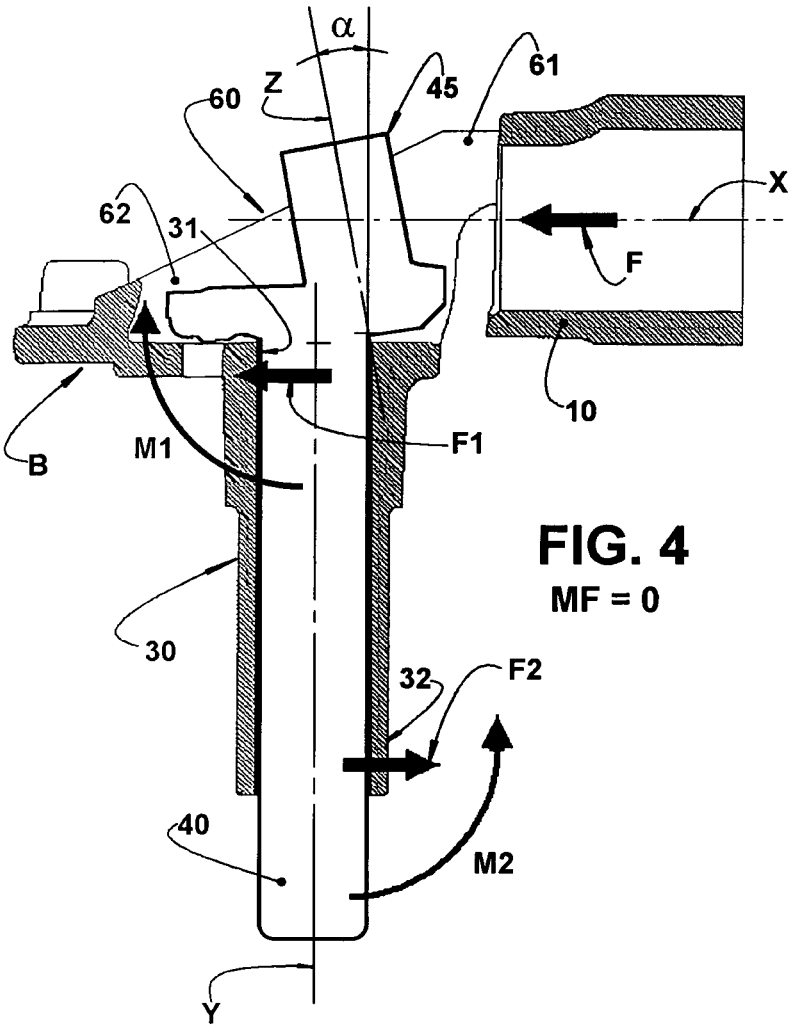
FIG. 4 represents, schematically, a longitudinal sectional view of the block constructed according to the present invention, comprising a crankshaft, a connecting rod and a piston (the two latter not illustrated) in a piston compression operational condition, with the vertical axis of the shaft hub being maintained orthogonal to the horizontal axis of the piston hub, whilst the axis of the eccentric end portion of the crankshaft presents an angular displacement away from its orthogonality with the horizontal axis of the piston hub.

In the operational condition represented in FIG. 4, the resulting bending moment MF generated by the first and second bending moments M1, M2 is annulled, maintaining the vertical axis Y of the shaft hub 30 in its condition orthogonal to the horizontal axis X of the piston hub 10, even when the piston 20 is in its compression cycle.

Figure 5:
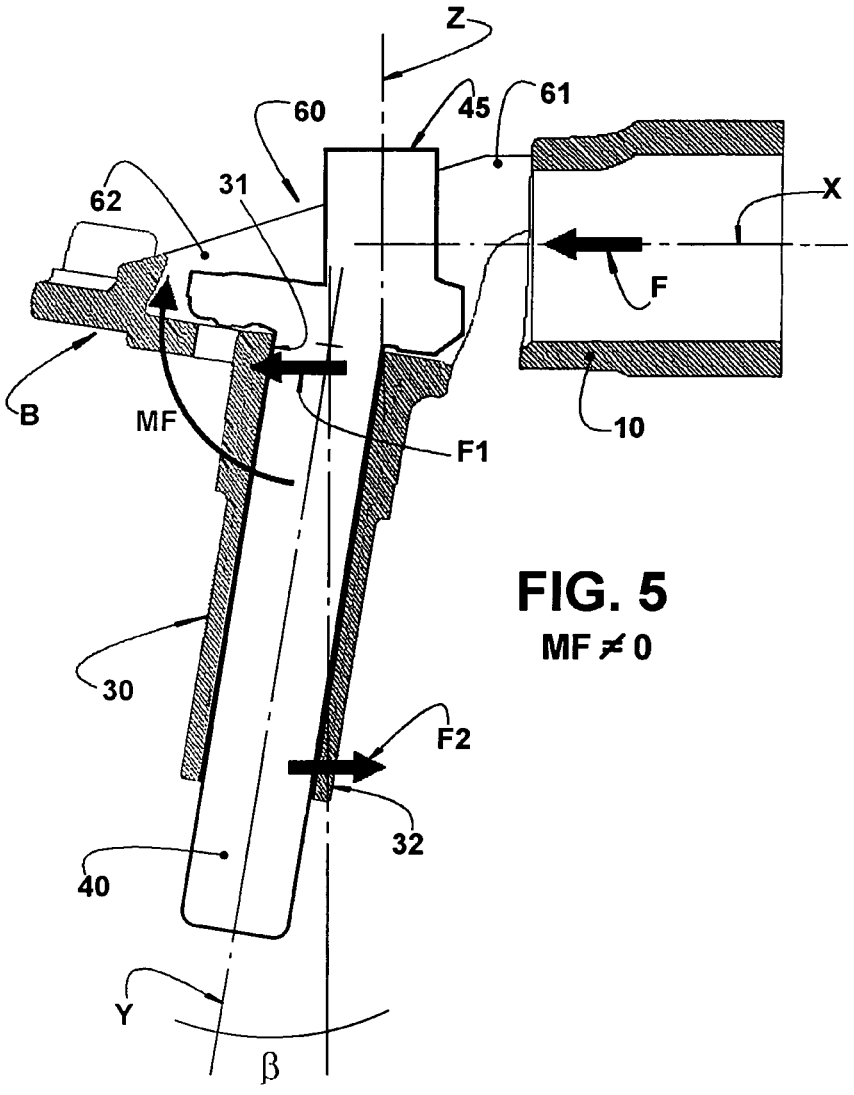
FIG. 5 represents a view similar to that of FIG. 4, but illustrating an elastic deformation condition of the connecting portion, determined to permit an angular displacement of the shaft hub sufficient to compensate the angular displacement of the eccentric portion of the crankshaft, maintaining said eccentric portion with its axis orthogonal to the horizontal axis of the piston hub.

In the operational condition represented in FIG. 5, the connecting portion 60 is constructed so that its elastic deformation limits the angular displacement (angle β) of the vertical axis Y of the shaft hub 30, away from the orthogonality in relation to the horizontal axis X of the piston hub 10, to a value corresponding to an angular displacement (angle α) of the eccentric end portion 45 of the crankshaft 40 in the opposite direction, by a compression reaction force F applied to said eccentric portion, by the connecting rod 50, during the compression cycles of the piston 20. In this operational condition represented in FIG. 5, the resulting bending moment MF, generated by the first and second bending moments M1, M2, is different from zero, so as to produce an elastic deformation of the connecting portion 60 which tends to provoke an angular displacement of the vertical axis Y of the shaft hub 40 away from the piston hub 10 that is, in the direction of the first compression derived force F1. This allows the angular displacement of the shaft hub 30 necessary to maintain the axis Z of the eccentric end portion 45 of the crankshaft 40 orthogonal to the horizontal axis X of the piston hub 10.

In the constructive condition operationally represented in FIG. 5, it is admitted a certain angular displacement of the shaft hub 30, so as to compensate the angular deformation of the eccentric end portion 45. This allows that, during the compression cycles of the piston 20, said eccentric end portion 45 remains in its nominal positioning for bearing the larger eye 51 of the connecting rod 50, preventing radial forces to be applied on the piston 20 and, consequently, minimizing the energy consumption and the metallic contact between the relatively movable parts, thus increasing the durability and reliability of the mechanical assembly.

Figure 6:
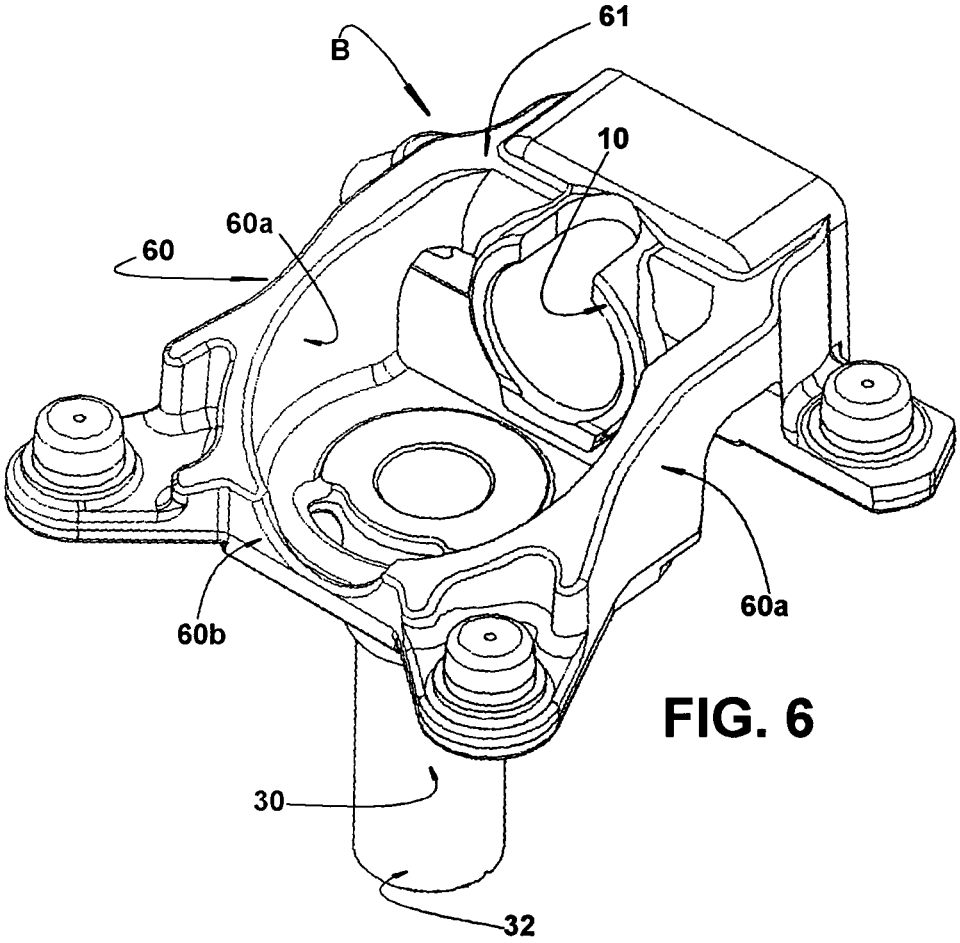
FIG. 6 represents a somewhat simplified upper perspective view of the block constructed according to the present invention but deprived of the other components: crankshaft, connecting rod, pin and piston.

In the construction illustrated in FIGS. 4, 5 and 6, the connecting portion 60 is defined in a single-piece with the parts defined by the piston hub 10 and the shaft hub 30. However, it should be understood that different constructions can be applied to the block, with the connecting portion 60 being incorporated, in a single-piece, to at least one of said parts of piston hub 10 and shaft hub 30.

FIG. 6 illustrates a construction for the connecting portion 60 which presents a laid U-shaped structure having the free ends of its lateral legs 60*a* attached to the piston hub 10, on opposite sides of its horizontal axis X, and its base leg 60*b* and the adjacent portions of its lateral legs 60*a* being attached to the adjacent end portion 31 of the shaft hub 30, on opposite sides of its vertical axis Y. However, it should be understood that the connecting portion 60 may present different structural embodiments, as long as it allows that the bending moment MF resulting from the first and second bending moments M1, M2 tends to provoke an angular displacement of the vertical axis Y of the shaft hub 40, away from the piston hub 10, that is, in the direction of the first compression derived force F1.

Although not illustrated, the present invention can be applied to constructions of block B for refrigeration compressors presenting two or more piston hubs, each housing a respective piston, independently of whether, in these constructions, the horizontal axis of said piston hubs define the same horizontal plane or the same vertical plane (for example, when the piston hubs are vertically aligned). In these block arrangements for compressors with multiple pistons operating in anti-phase during the respective compression cycle, there is provided a connecting portion 60 of the type described herein, defining a single connection between each piston hub 10 and the shaft hub 30.

While only one exemplary construction for a compressor block has been presented herein, it should be understood that other possible constructions can be presented, without departing from the inventive concept defined in the claims that accompany the present specification.

The invention claimed is:

1. A block for a reciprocating refrigeration compressor of the type which includes a block (B) comprising at least one piston hub having a horizontal axis (X) and housing a reciprocating piston, and a shaft hub having an adjacent end portion, a free end portion and a vertical axis (Y) which intersects the horizontal axis (X) of the piston hub, said shaft hub housing a crankshaft which incorporates an eccentric end portion projecting outwards from the adjacent end portion of the shaft hub and coupled to the piston by a connecting rod, said block (B) being characterized in that it incorporates a pair of connecting portions each of the pair of connecting portions having a first end attached to a region of the respective piston hub disposed above the horizontal axis (X), wherein above is defined as the side of the horizontal axis (X) opposite the side turned to the shaft hub, and a second end attached to the adjacent end portion of the shaft hub, said connecting portions defining the only structural connections between the two parts of block (B) which are defined by the respective piston hub and the shaft hub and being elastically deformable, by a resulting bending moment (MF) generated: by a first compression derived force (F1) actuating on the adjacent end portion of the shaft hub and imparting, to the second ends of the connecting portions, a first bending moment (M1); and by a second compression derived force (F2) applied, by the crankshaft, to the free end portion of the shaft hub and imparting, to the latter, a second bending moment (M2) opposite to the first bending moment (M1), and which tends to provoke, by the elastic deformation of the connection portions, an angular displacement of the vertical axis (Y) of the shaft hub, in the direction of the first compression derived force (F1), said elastic deformation of the connecting portions annulling or limiting, to a predetermined value, the angular displacement of the vertical axis (Y) of the shaft hub away from the orthogonality in relation to the horizontal axis (X) of the piston hub.

2. The block, as set forth in claim 1, characterized in that the connecting portions present a laid U-shaped structure having the free ends of its lateral legs attached to the piston hub, on opposite sides of its horizontal axis (X), and its base leg and the adjacent portions of its lateral legs being attached to the adjacent end portion of the shaft hub, on opposite sides of its vertical axis (Y).

3. The block, as set forth in claim 1, characterized in that the elastic deformation of the connecting portions limits the angular displacement of the vertical axis (Y) of the shaft hub, away from the orthogonality in relation to the horizontal axis (X) of the piston hub, to a value corresponding to an angular displacement of the eccentric end portion of the crankshaft in the opposite direction, by a compression reaction force (F) applied to said eccentric portion by the connecting rod during the compression cycles of the piston.

4. The block, as set forth in claim 1, characterized in that the connecting portions are defined in a single-piece with at least one of the parts defined by the piston hub and by the shaft hub.

* * * * *